United States Patent [19]

Baines

[11] Patent Number: 4,606,703

[45] Date of Patent: Aug. 19, 1986

[54] FLUIDIC PUMPING SYSTEMS WITH CONTROL MEANS RESPONSIVE TO LIQUID LEVEL

[75] Inventor: Joga S. Baines, Thornton Cleveleys, England

[73] Assignee: United Kingdom Atomic Energy Authority, London, England

[21] Appl. No.: 718,506

[22] Filed: Apr. 2, 1985

[30] Foreign Application Priority Data

Apr. 4, 1984 [GB] United Kingdom ..... 8408623

[51] Int. Cl.[4] ..... F04B 23/14; F04F 1/02

[52] U.S. Cl. ..... 417/86; 417/87; 417/138; 417/145; 417/149

[58] Field of Search ..... 417/54, 65, 76, 86, 417/87, 138, 145, 149, 182.5

[56] References Cited

U.S. PATENT DOCUMENTS

| | | | |
|---|---|---|---|
| 640,023 | 12/1899 | Perkins | 417/86 |
| 1,748,361 | 2/1930 | Mingus et al. | 417/138 |
| 2,669,941 | 2/1954 | Stafford | 417/138 X |
| 3,106,170 | 10/1963 | Gray | 417/138 |
| 3,320,970 | 5/1967 | McHenry | 417/138 X |
| 4,021,146 | 5/1977 | Tippetts et al. | 417/76 |
| 4,021,147 | 5/1977 | Brekke | 417/138 |

FOREIGN PATENT DOCUMENTS

| | | |
|---|---|---|
| 1249640 | 10/1971 | United Kingdom . |
| 1271907 | 4/1972 | United Kingdom . |
| 2006959 | 5/1979 | United Kingdom . |

*Primary Examiner*—William L. Freeh
*Assistant Examiner*—Paul F. Neils
*Attorney, Agent, or Firm*—King and Schickli

[57] ABSTRACT

A fluidic pumping system comprises a reverse flow diverter positioned below the level of a liquid to be pumped and inserted between a charge vessel and a delivery pipe. A control system including pressure-responsive devices effects alternate pressurizing and venting of the charge vessel for pumping the liquid. Passage of liquid from the charge vessel into pipes leading to a compressed air supply and the reverse flow diverter generates pressure changes which are detected and the electric output signals are used to operate the control means.

2 Claims, 1 Drawing Figure

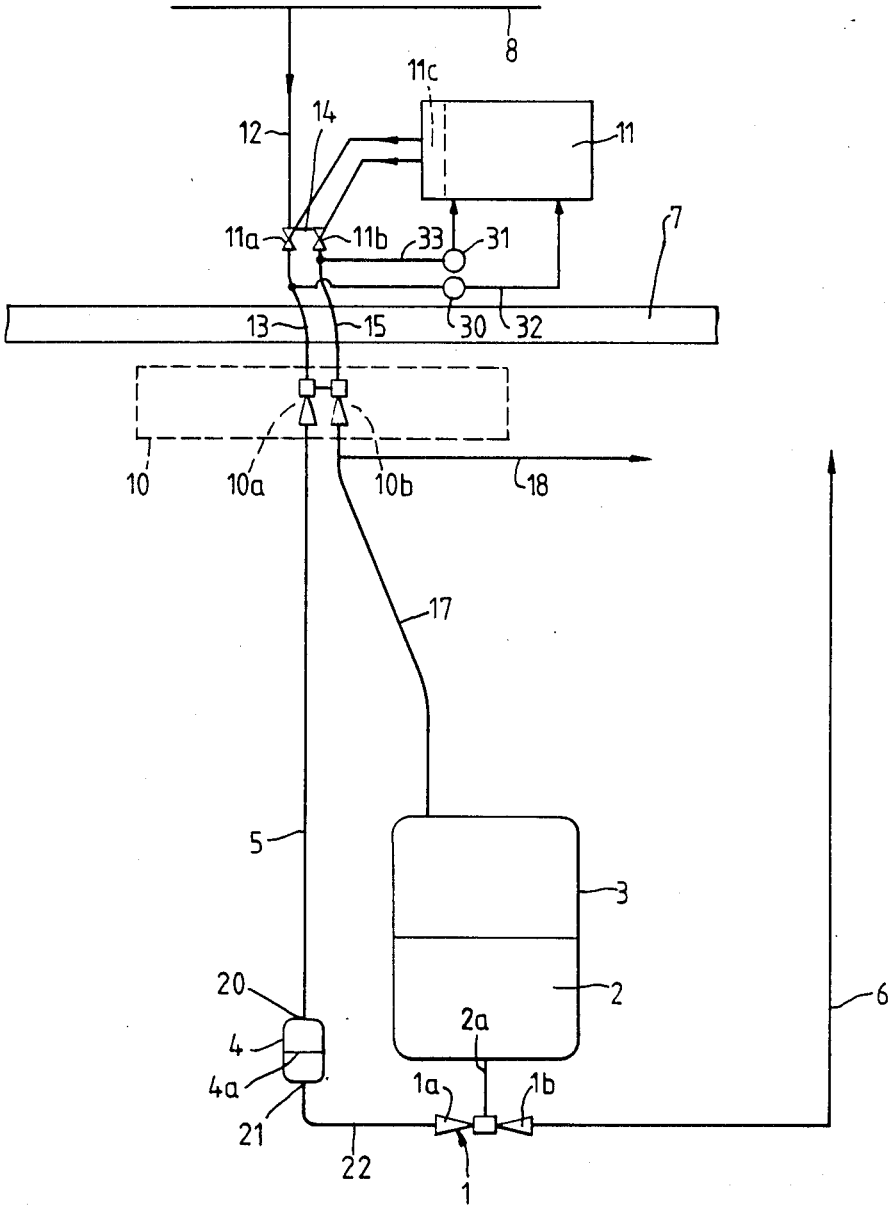
8
11c
14
12
11
11a
11b
33
31
7
13
15
30
32
10
10a
10b
18
17
5
3
2
20
2a
6
4
4a
1a
1b
21
22
1

FLUIDIC PUMPING SYSTEMS WITH CONTROL MEANS RESPONSIVE TO LIQUID LEVEL

The present invention concerns pumping systems incorporating fluidic devices.

Pumping systems incorporating fluidic devices are attractive for pumping hazardous liquids, such as radioactive liquors, as the fluidic devices do not include moving parts which could require repair or replacement with consequent risk to maintenance personnel. A known pumping system incorporates a fluidic device known as a reverse flow diverter RFD and examples of RFD's and their manner of operation are given in British Patent Specification No. 1,480,484.

Basically, an RFD is a venturi-like device comprising two conical diffuses separated by a gap. The nozzles of the diffuses are opposed to each other and separated by the gap which opens into a liquid to be pumped or lifted. On connecting a cylinder to the end of one diffuser remote from the gap, the application of reciprocating pressure to the cylinder causes the liquid to be alternately drawn into the cylinder through the gap and pumped across the gap and through an outlet pipe connected to the end of the other diffuser remote from the gap.

The pumping systems include means for controlling operations and conventionally such control is obtained by timers and solenoid-operated valves.

According to the present invention a method of controlling the operation of a fluidic pumping system, at least during a suction stroke of a pumping cycle, comprises detecting a pressure change resulting from a change in surface area of a liquid level in the system and utilising the pressure change to provide a control signal for initiating a further cycle of operation.

The invention also includes a fluidic pumping system comprising a vessel for a liquid to be pumped, a reverse flow diverter positioned at a level below the level of the liquid to be pumped, a charge vessel and a delivery pipe with the reverse flow diverter inserted therebetween, compressed gas supply means for the charge vessel, and control means for effecting alternate pressurising and venting of the charge vessel to effect pumping of the liquid, the control means including a conduit communicating with the charge vessel, and pressure responsive means for detecting the liquid level at at least one position in the operating cycle of the pump system.

There may be valve means operable in response to signals generated by the pressure-responsive means for alternately pressurising and venting the charge vessel.

The control means may comprise a primary controller having air drive and suction pumps and a secondary controller comprising the valve means and pressure-responsive means, the primary controller, charge vessel, reverse flow diverter, and vessel for liquid to be pumped being located within a shield.

During a suction stroke the liquid is drawn through the RFD to refill a charge vessel as a result of suction applied to the charge vessel through a smaller diameter pipe. The change in liquid surface area as the level of the liquid passes from the charge vessel into the pipe is capable of providing a detectable signal for termination of the suction stroke.

The invention may be performed in various ways and one specific embodiment will be described further, by way of example, with reference to the accompanying schematic illustration of a pumping system.

A fluidic device 1 of the kind known as a reverse flow diverter, RFD, comprises two opposed, co-axial conical nozzles 1*a*, 1*b* separated by a gap, the gap communicating through line 2*a* with a liquid 2 to be pumped and contained in a supply tank 3. One nozzle 1*a* of the RFD is connected via line 22 to a charge vessel 4 having an air link pipe 5. The other nozzle 1*b* of the RFD is connected to a delivery pipe 6.

The operation is controlled by a dual control arrangement comprising a primary controller 10 and a secondary controller 11. The primary controller 10 comprises twin jet pumps and for pumping active liquors the primary controller is positioned within a biological shield 7. The secondary controller 11 is situated outside the shield 7 and comprises solenoid-operated and timer-controlled air admittance valves 11*a*, 11*b*.

The pumping system is known and does not require detailed description. Briefly, during a drive stroke with valve 11*a* open and valve 11*b* closed, compressed air from a line 8 is admitted through lines 12, 13 and valve 11*a* to the drive jet pump 10*a* of the primary controller 10 and then to the charge vessel 4 via line 5 and liquid is delivered in line 6. On a vent stroke, the air supply in line 13 is shut off by closing valves 11*a*, 11*b* and the charge vessel is vented through line 18. Finally, during a suction stroke with valve 11*a* closed and valve 11*b* open, air is admitted to the suction jet pump 10*b* of the primary controller 10 via line 12, 14, 15 and valve 11*b* to create a depression in the charge vessel to draw liquid from vessel 3 into vessel 4. Line 18 connects line 17 to vent. The sequence of operations is controlled by the timers 11*c* included in the secondary controller which function to open and close the solenoid-operated valves 11*a*, 11*b* at preset intervals to direct compressed air through the drive and suction jet pumps 10*a*, 10*b*. Tank 3 is connected to vent through line 17.

It is now proposed to control operation directly from the level 4*a* of liquid in the charge vessel 4. During a suction stroke the charge vessel 4 is refilled with liquor from the supply tank 3. When the liquor level 4*a* reaches the junction 20 of the charge vessel 4 with the pipe 5 the liquid encounters a restricted flow path because of the change in surface area in passing from the charge vessel into the pipe. This pressure change produces a small but detectable pressure drop which can be used to provide a signal for actuation of the solenoid-operated valves 11*a*, 11*b* of the secondary controller 11. Thus, the duration of the suction stroke is determined by the liquor/air interface 4*a* passing from the charge vessel 4 into the pipe 5 as detected by transducer 31. A similar pressure drop can likewise be detected by transducer 30 on the drive stroke when the interface reaches the junction 21 with the end of the pipe 22 leading to the RFD 1.

In the RFD system, the charge vessel 4 refills at a reasonably steady flowrate until the liquid reaches the pipe 5 connecting the vessel 4 to the primary controller. At this point, the pipe 5 fills very quickly because of its relatively small volume, which causes the pressure created in the pipe by the primary controller 10 to also change rapidly. It is this sudden pressure change which is detected.

Pressure-responsive transducers 30, 31 are connected in lines 32, 33 respectively between lines 13, 15 and secondary controller 11, which may comprise a computer and a signal analyser to analyse and respond to the electric output signals from the transducers 30, 31 and thereby control the opening and closing of valves 11*a*, 11*b*.

I claim:

1. A fluidic pumping system comprising a vessel for a liquid to be pumped, a reverse flow diverter positioned at a level below the level of the liquid to be pumped to receive liquid from the vessel, a charge vessel, a delivery pipe, said reverse flow diverter operatively positioned between the charge vessel and the delivery pipe, compressed gas supply means for the system, and control means connected to the gas supply means for effecting alternate pressurizing and venting of the charge vessel to effect pumping of the liquid, the control means including a conduit communicating with the charge vessel, pressure-responsive means for detecting the liquid level at at least one position in the operating cycle of the pump system, valve means operable in response to signals generated by the pressure-responsive means for effecting said alternate pressurizing and venting of the charge vessel, the control means further comprising a primary controller having an air drive pump connected to the conduit and a suction pump connected to the vessel for liquid to be pumped, and a secondary controller comprising the valve means and the pressure-responsive means, the primary controller, charge vessel, reverse flow diverter, and vessel for liquid to be pumped being located within a shield.

2. A fluidic pumping system as claimed in claim 1, in which the pressure-responsive means is adapted to detect pressure change as the liquid level enters said conduit.

* * * * *